US007581417B1

(12) United States Patent
Chen

(10) Patent No.: US 7,581,417 B1
(45) Date of Patent: Sep. 1, 2009

(54) LOCKING DEVICE WITH CHANGEABLE COMBINATION OF NUMERALS FOR LOCKING A CONNECTING PORT ON A COMPUTER

(76) Inventor: Yen-Hsiang Chen, 14F., No. 28, Lane 167, Zhongzheng Rd., Zhonghe City, Taipei County (TW) 235

( * ) Notice: Subject to any disclaimer, the term of this patent is extended or adjusted under 35 U.S.C. 154(b) by 0 days.

(21) Appl. No.: 12/187,203

(22) Filed: Aug. 6, 2008

(51) Int. Cl.
*E05B 65/00* (2006.01)

(52) U.S. Cl. ..... 70/57; 70/58; 439/133

(58) Field of Classification Search ..... 70/14, 70/18, 57, 58, 312, 314, 315; 439/133, 135
See application file for complete search history.

(56) References Cited

U.S. PATENT DOCUMENTS 4,964,284 A * 10/1990 McDaid ..... 70/14
5,190,466 A * 3/1993 McVey ..... 439/304
5,344,329 A * 9/1994 Faller ..... 439/133
6,058,744 A * 5/2000 Ling ..... 70/28
6,973,809 B2 * 12/2005 Chang ..... 70/58
6,991,479 B2 * 1/2006 Miao ..... 439/133
7,128,586 B2 * 10/2006 Kung ..... 439/133
7,305,714 B2 * 12/2007 Hamaguchi et al. ..... 726/34
7,390,201 B1 * 6/2008 Quinby et al. ..... 439/133
7,428,834 B1 * 9/2008 Lee ..... 70/57
7,465,181 B1 * 12/2008 Bridges et al. ..... 439/358
7,479,021 B2 * 1/2009 Huang ..... 439/133
2003/0224637 A1 * 12/2003 Ling ..... 439/133
2004/0074264 A1 * 4/2004 Kung et al. ..... 70/58
2005/0039502 A1 * 2/2005 Avganim ..... 70/58
2005/0202698 A1 * 9/2005 Miao ..... 439/133
2006/0107073 A1 * 5/2006 Lane et al. ..... 713/194
2007/0162655 A1 * 7/2007 Huang ..... 710/36
2008/0041125 A1 * 2/2008 Poppe ..... 70/57

* cited by examiner

*Primary Examiner*—Suzanne D Barrett
(74) *Attorney, Agent, or Firm*—WPAT, P.C.; Anthony King

(57) ABSTRACT

A locking device with changeable combination of numerals includes an enclosure having an insertion section and an axial row of windows; a locking unit arranged in the enclosure and including a rod having axially spaced teeth, a push member connected to one end of the rod, a hooking member connected to the push member with two hooking arms extended into two holes on the insertion section, an elastic member located between the push member and the insertion section, sleeves mounted on the rod, rotating discs fitted on the sleeves corresponding to the windows, and a push disc mounted to another end of the rod; and a push button on the enclosure to interfere with the push member. By pushing the push disc, the rotating discs can be turned to change the combination of numerals set for the locking unit.

4 Claims, 6 Drawing Sheets

A-A

LOCKING DEVICE WITH CHANGEABLE COMBINATION OF NUMERALS FOR LOCKING A CONNECTING PORT ON A COMPUTER

FIELD OF THE INVENTION

The present invention relates to a locking device with changeable combination of numerals for locking a connecting port on a computer, and more particularly to a locking device that can be locked to a connecting port on a computer to hinder any unauthorized external storage device from connecting to the connecting port. Therefore, data stored on the computer are protected against unauthorized access.

BACKGROUND OF THE INVENTION

With the rapidly developed information technologies, computer has become one of many prerequisite electronic products in people's daily life. Computers are used in word processing, storage and processing of video files, audio files, multimedia files, and other important digital data, etc. In general, a computer is equipped with a hard disk drive, a compact disk drive, a floppy disk drive, etc. for reading and storing data. A computer can also be connected to various portable storage devices, such as portable hard disks, USB flash disks, etc., so that data in the computer can be stored on the portable storage device for use at different places.

A portable storage device generally has a universal serial bus (USB) plug as a transmission interface. In use, the USB plug can be directly plugged in a USB connector on a computer case to achieve the effect of Plug and Play for data transmission. Accordingly, with the USB interface, a user can conveniently use the portable storage device. However, due to the Plug and Play effect of the USB interface, even an unauthorized user can freely download all data stored in the computer with any portable storage device. Therefore, personal or private data stored in the computer are dangerously subject to stealing and illegally disclosure.

SUMMARY OF THE INVENTION

A primary object of the present invention is to provide a locking device with changeable combination of numerals for locking a connecting port on a computer. The locking device can be locked to a connecting port on a computer to hinder any unauthorized external storage device from connecting to the connecting port. Moreover, the locking device is configured to allow a user to change the combination of numerals set for the locking device according to actual need. Therefore, data stored on the computer can be more effectively protected against unauthorized access.

To achieve the above and other objects, the locking device with changeable combination of numerals for locking a connecting port on a computer according to the present invention includes an enclosure, a locking unit, and at least one push button.

The enclosure has an insertion section formed at a first end thereof, the insertion section being provided with two corresponding holes corresponding to two retaining holes in the connecting port, and having a fixing seat received therein; a plurality of windows formed on at least one of an upper and a lower side of the enclosure; and a supporting plate located in the enclosure at a second end thereof opposite to the first end.

The locking unit is arranged in the enclosure and includes a rod, a push member, a hooking member, an elastic member, a plurality of sleeves, a plurality of rotating discs, and a push disc.

The rod has a line of teeth axially spaced on an outer circumferential surface thereof, and is movably connected at one of two ends to the supporting plate and fixedly connected at the other end to an end of the push member.

The push member is provided at another end opposite to the rod with an engaging portion.

The hooking member is movably connected to the push member by engaging with the engaging portion. The hooking member has a first end in the form of a cross plate confined in the enclosure, and an opposite second end in the form of two hooking arms detachably extended into the holes on the insertion section of the enclosure and the retaining holes in the connecting port.

The elastic member is located between the push member and the fixing seat.

The sleeves are mounted on and around the rod between the supporting plate and the push member, and each are provided with an axially extended slot corresponding to the teeth, two diametrically opposite and externally projected wing portions located at two sides of the slot, and an annular groove formed in and around an end of each sleeve to communicate with the axial slot.

The rotating discs are fitted on and around the sleeves, and each are provided along an outer circumferential surface with a plurality of sequentially arranged numeral areas, such that the numeral areas on the same one rotating disc can be selectively exposed from one of the windows on the enclosure corresponding to that rotating disc by turning the rotating disc; and the rotating discs each are provided on an inner circumferential surface with a toothed portion for detachably engaging with the wing portions on a corresponding sleeve.

The push disc is mounted on the rod at the end connected to the supporting plate.

The at least one push button is movably arranged on at least one of two lateral sides of the enclosure to interfere with at least one side of the push member.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
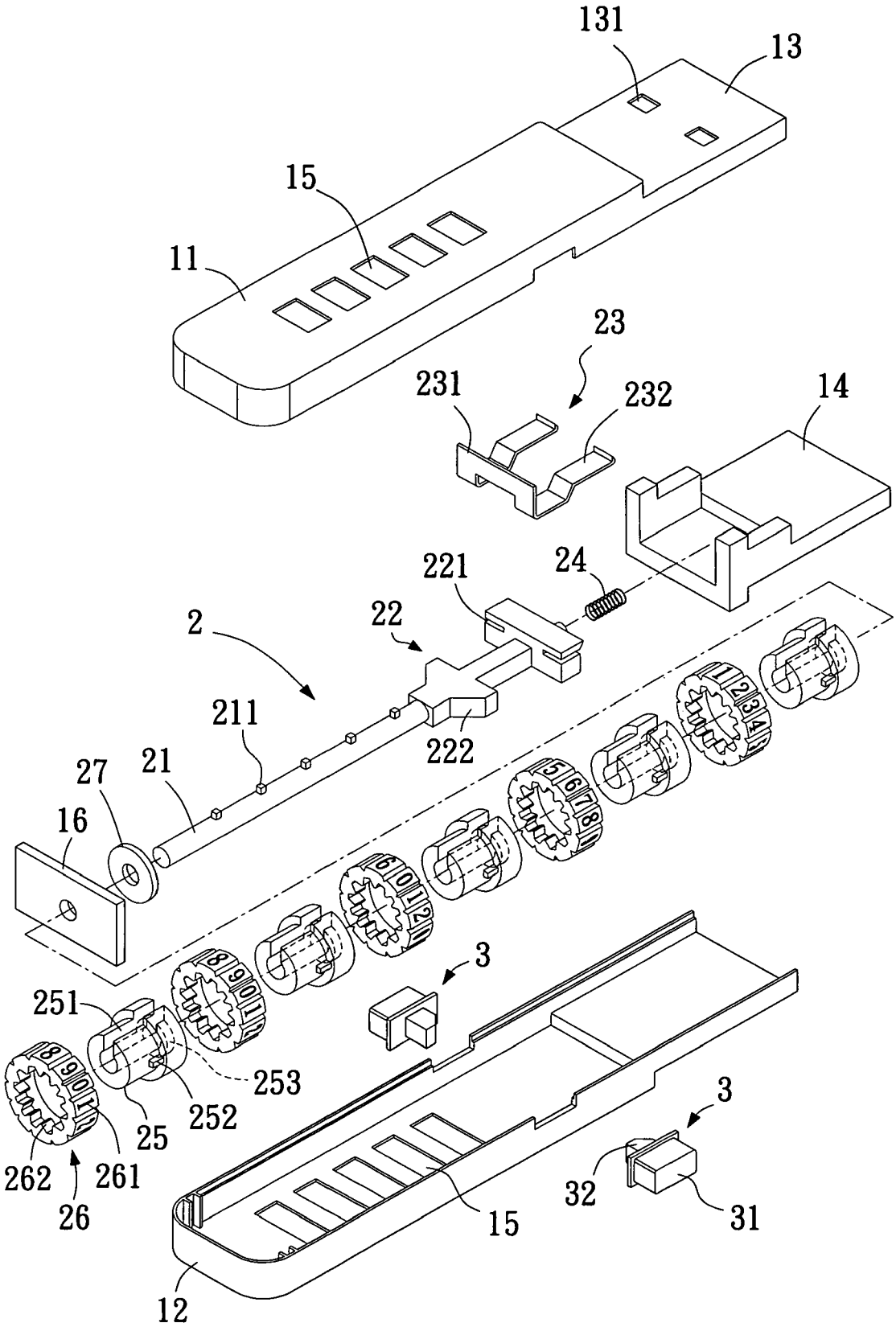
FIG. 1 is an exploded perspective view of a locking device with changeable combination of numerals for locking a connecting port on a computer according to the present invention.
Figure 2:
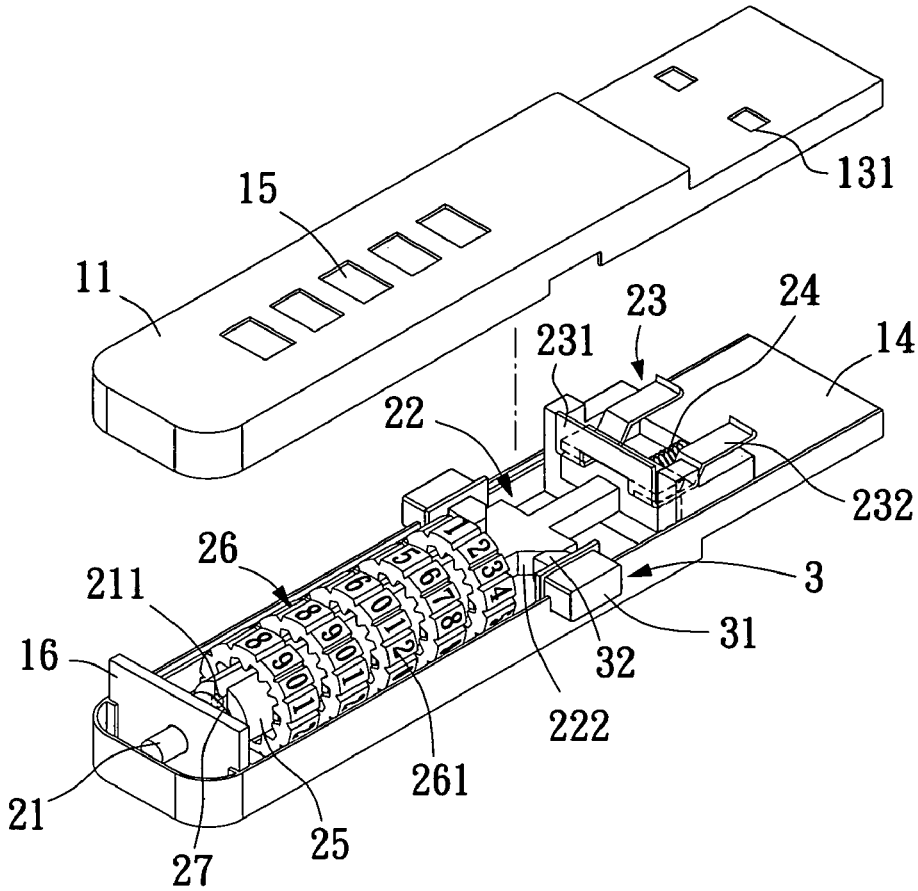
FIG. 2 is a partially assembled perspective view of FIG. 1.
Figure 3:
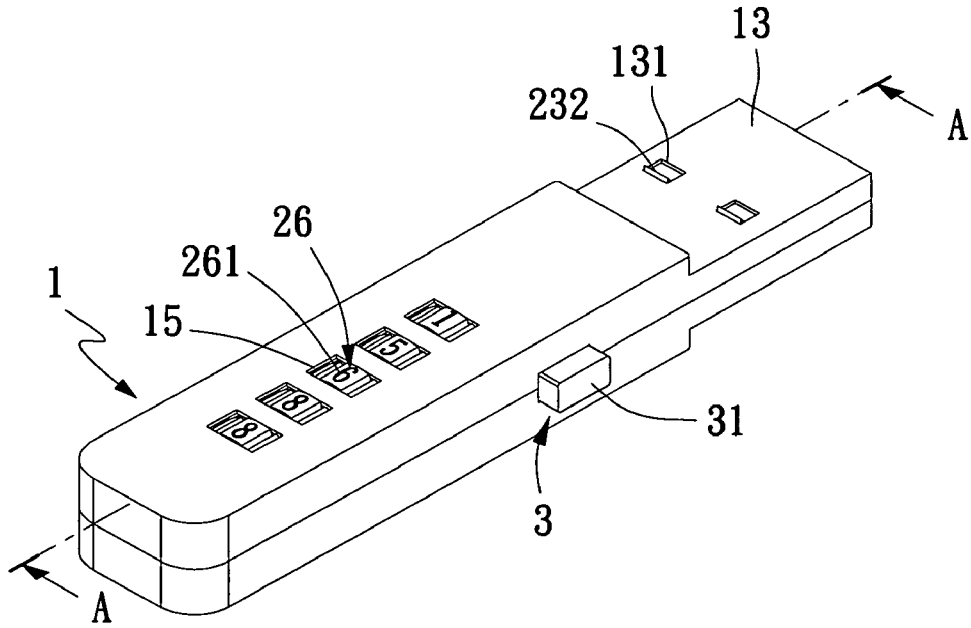
FIG. 3 is a fully assembled perspective view of FIG. 1.
Figure 4:
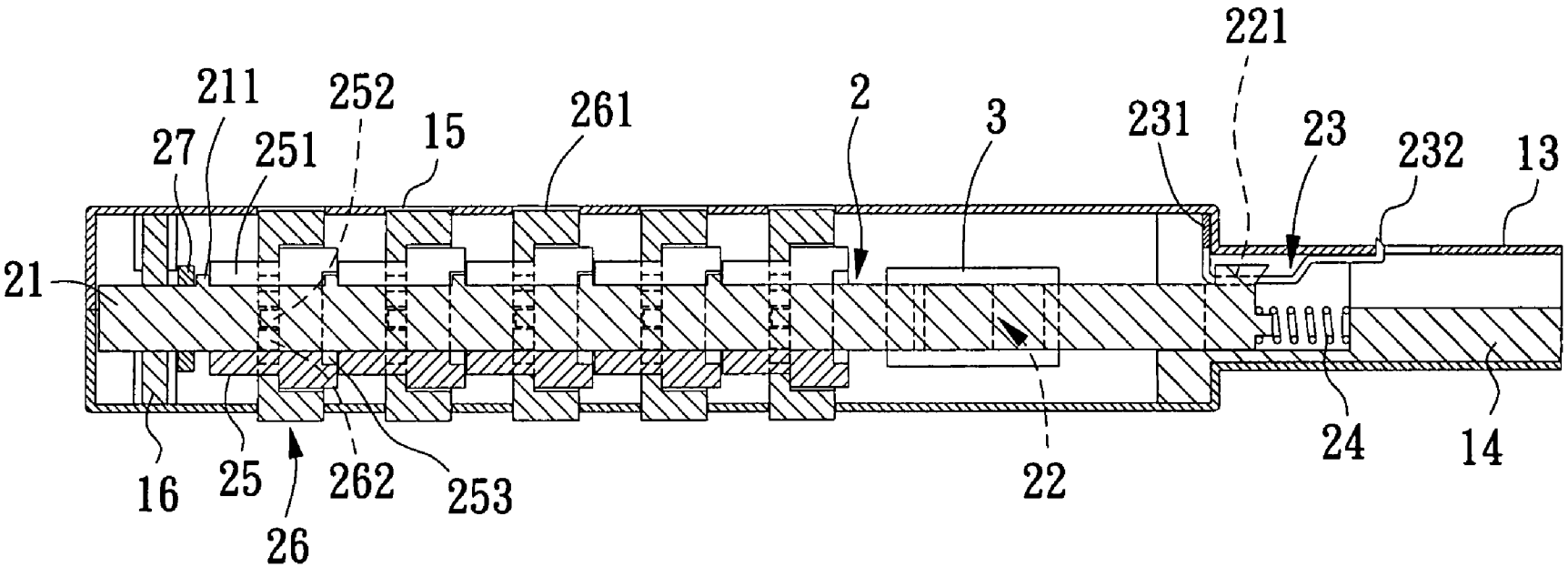
FIG. 4 is a sectional view taken along line A-A of FIG. 3.

Please refer to FIGS. 1, 2, and 3 that are fully exploded, partially assembled, and fully assembled perspective views, respectively, of a locking device with changeable combination of numerals for locking a connecting port on a computer according to the present invention, and to FIG. 4 that is a sectional view taken along line A-A of FIG. 3. As shown, the locking device with changeable combination of numerals according to the present invention includes an enclosure 1, a locking unit 2, and at least one push button 3.

The enclosure 1 is composed of an upper cover 11 and a lower cover 12. A first end of the enclosure 1 forms an insertion section 13 having two corresponding holes 131 provided thereon. The insertion section 13 can be configured as a USB plug. A fixing seat 14 is located in the insertion section 13 of the enclosure 1. A plurality of windows 15 are formed on at least one of an upper and a lower side of the enclosure 1. And, a supporting plate 16 is located at and in a second end of the enclosure 1 opposite to the first end.

The locking unit 2 is arranged in the enclosure 1, and includes a rod 21 movably connected at one of two ends to the supporting plate 16 and having a line of teeth 211 axially spaced on and along an outer circumferential surface thereof; a push member 22 located at the other end of the rod 21 and having an engaging portion 221; a hooking member 23 movably connected to the engaging portion 221; an elastic member 24 located between the push member 22 and the fixing seat 14; a plurality of sleeves 25 mounted on and around the rod 21 between the supporting plate 16 and the push member 22, a plurality of rotating discs 26 sequentially fitted on and around the sleeves 25, and a push disc 27 mounted on the rod 21 at the end connected to the supporting plate 16. An inclined shoulder portion 222 is formed on at least one lateral side of the push member 22. The hooking member 23 has a first end in the form of a cross plate 231 confined in the enclosure 1, and an opposite second end in the form of two hooking arms 232 detachably extended into the holes 131 on the insertion section 13. The sleeves 25 each are provided with an axially extended slot 251 corresponding to the teeth 211, two diametrically opposite and externally projected wing portions 252 located at two sides of the slot 251, and an annular groove 253 formed in and around an end of each sleeve 25 to communicate with the axial slot 251. The rotating discs 26 each are provided along an outer circumferential surface with a plurality of sequentially arranged numeral areas 261, such that the numeral areas 261 on the same one rotating disc 26 can be selectively exposed from one of the windows 15 corresponding to that rotating disc 26 by turning the rotating disc 26. The rotating discs 26 each are also provided on an inner circumferential surface with a toothed portion 262, which is able to detachably engage with the wing portions 252 on one corresponding sleeve 25.

The push button 3 is movably arranged on at least one lateral side of the enclosure 1. A first end of the push button 3 is a push section 31 outward protruded from the enclosure 1, and an opposite second end of the push button 3 is a driving head 32 interfering with the inclined shoulder portion 222 of the push member 22.

Figure 5:
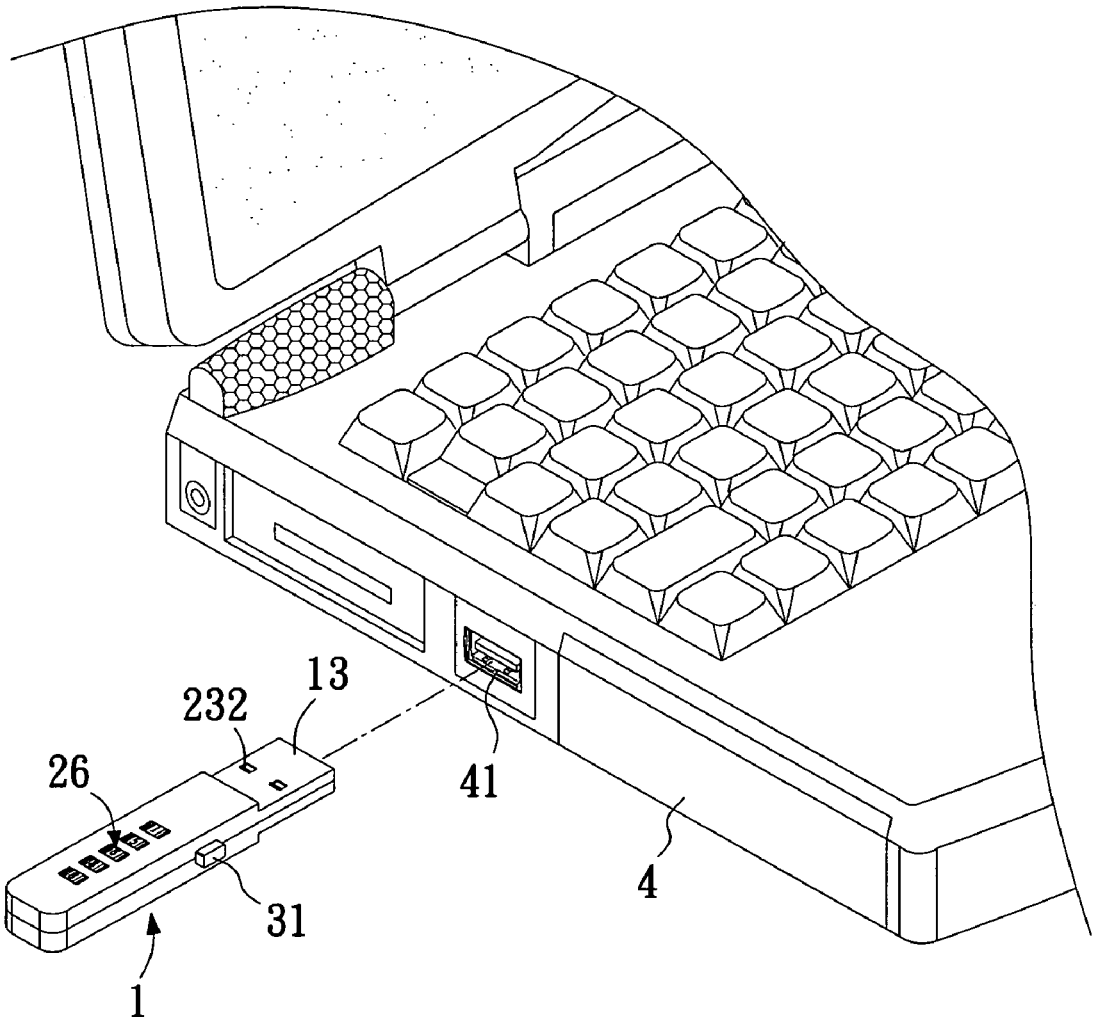
FIG. 5 is a perspective view showing the use of the locking device of the present invention to lock a connecting port provided on a computer.
Figure 6:
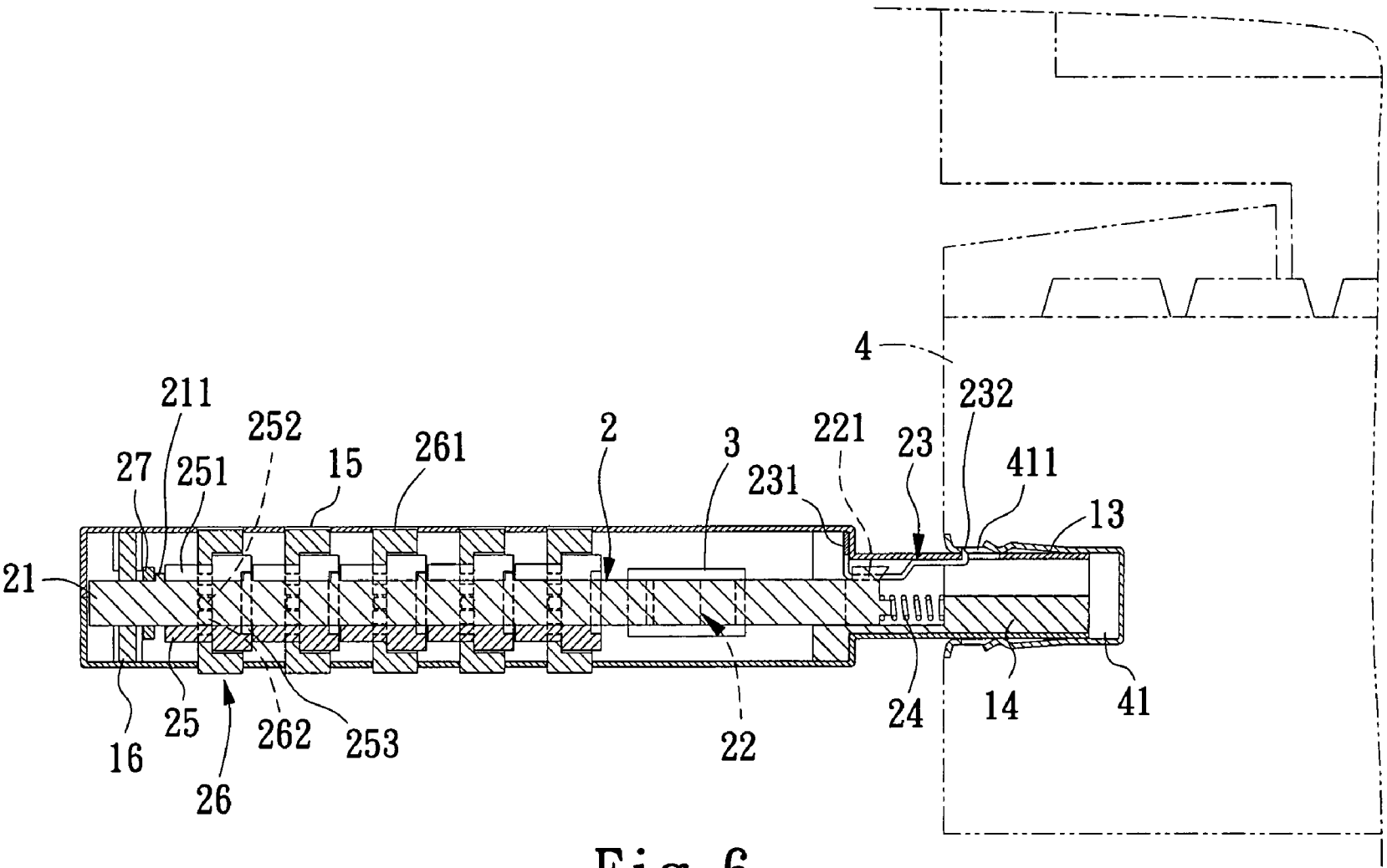
FIG. 6 is a sectional view showing the locking device of the present invention having been locked to the connecting port.
Figure 7:
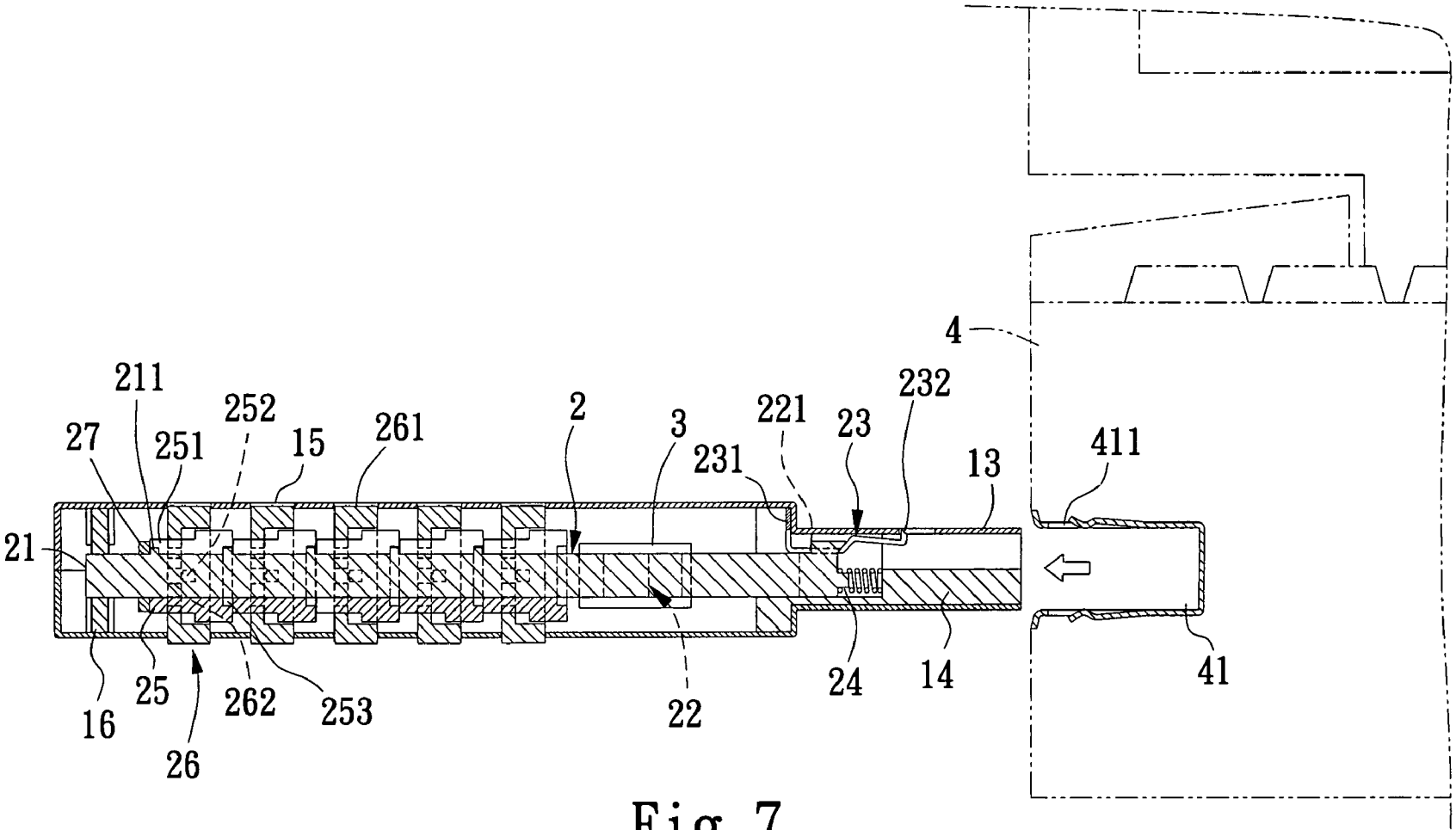
FIG. 7 is a sectional view showing the locking device of the present invention being separated from the connecting port to unlock the latter.

FIG. 5 is a perspective view showing the use of the locking device of the present invention to lock a connecting port 41 on a computer case of a computer 4, and FIGS. 6 and 7 are sectional views showing the locking device of the present invention locked to and detached from the connecting port 41, respectively. To use the locking device of the present invention to lock the connecting port 41, which can be a USB connecting port, the insertion section 13 of the enclosure 1 is directly inserted into the USB connecting port 41 on the computer case of the computer 4. At this point, the hooking arms 232 on the hooking member 23 of the locking unit 2 are elastically compressed downward by an inner wall surface of the USB connecting port 41. When the insertion section 13 has been moved further into the USB connecting port 41 with the hooking arms 232 aligned with two retaining holes 411 formed on the inner wall surface of the USB connecting port 41, the hooking arms 232 are no longer compressed by the inner wall surface of the USB connecting port 41 and automatically spring out of the holes 131 into the retaining holes 411. When the locking device is in a locked state, the teeth 211 on the rod 21 are separately located in the annular grooves 253 in the sleeves 25 to dislocate from the axial slots 251 on the sleeves 25, and the driving head 32 of the push button 3 pushed against the inclined shoulder portion 222 of the push member 22 could not drive the rod 21 forward. Accordingly, with the hooking arms 232 of the locking unit 2 extended into and held to the retaining holes 411, the insertion section 13 of the enclosure 1 is locked to the USB connecting port 41 on the computer 4, preventing any other external storage device from being plugged in the USB connecting port 41 to access data stored in the computer 4 without authorization.

When an authorized user of the computer 4 desires to use the USB connecting port 41, the user can turn the rotating discs 26 of the locking unit 2 via the windows 15, so that the toothed portions 262 in the rotating discs 26 cooperate with the wing portions 252 to rotate the sleeves 25, bringing the annular grooves 253 in an end of the sleeves 25 to rotate outside the teeth 211 of the rod 21 for a correct combination of numerals to show on the numeral areas 261 in the windows 262. Since the numeral areas 261 on each of the rotating discs 26 are initially set for a predetermined one of the numerals thereon to correspond to one tooth on the toothed portion 262 as well as to the axial slot 251 and the wing portions 252 on the corresponding sleeve 25, when the rotating discs 26 are rotated for the predetermined numerals on the numeral areas 261 to show at the windows 15 in a correct combination, the axial slots 251 on the sleeves 25 would align with the teeth 211 on the rod 21, allowing the line of teeth 211 on the rod 21 to move through the axial slots 251. At this point, the user can easily push the push section 31 of the push button 3 inward. When doing this, the driving head 32 of the push button 3 interferes with and slides along the inclined shoulder portion 222 to drive the push member 22 forward. At this point, the push member 22 is moved toward the fixing seat 14 to compress the elastic member 24 and bring the rod 21 to move forward, so that the engaging portion 221 urges and biases the hooking arms 232 of the hooking member 23 downward, bringing the hooking arms 232 to retract from the retaining holes 411 of the USB connecting port 41 into the holes 131 of the insertion section 13 to unlock the locking device from the USB connecting port 41, permitting the user to remove the insertion section 13 of the enclosure 1 from the USB connection port 41.

When it is desired to change the combination of numerals set for the rotating discs 26 of the locking unit 2, first set the locking device to the unlocked state, and then by moving the locking unit 2 toward the locking position, the push disc 27 at an end of the rod 21 pushes against the sleeve 25 that is immediately adjacent to the push disc 27, so that all other sleeves 25 are sequentially moved forward for the wing portions 252 on each of the sleeves 25 to separate from the toothed portion 262 of a corresponding rotating disc 26. At this point, the user needs only to rotate the rotating discs 26 for a desired set of numerals on the numeral areas 261 to show at the windows 15, and then releases the push button 3, so that the elastic member 24 is elastically restored and pushes the rod 21 backward, bringing the wing portions 252 on the sleeves 25 to engage with the toothed portions 262 in the rotating discs 26 again. In this manner, a new combination of numerals is set for the locking unit 2.

In conclusion, in the locking device with changeable combination of numerals according to the present invention, by means of the locking unit, the insertion section of the enclosure can be locked to a connecting port on a computer to hinder any unauthorized external storage device from linking with the connecting port. Moreover, the locking device of the present invention allows a user to change the combination of numerals for the locking unit according to actual need. Therefore, the data stored in the computer are protected from unauthorized access. With the above arrangements, the locking device of the present invention effectively overcomes the safety problems in the conventional connecting port on the computer, and is therefore improved and practical for use to meet general users' requirements.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A locking device with changeable combination of numerals for locking a connecting port on a computer, comprising:

an enclosure having an insertion section formed at a first end thereof, the insertion section being provided with two corresponding holes and having a fixing seat received therein; a plurality of windows formed on at least one of an upper and a lower side of the enclosure; and a supporting plate located in the enclosure at a second end thereof opposite to the first end;

a locking unit arranged in the enclosure and including a rod, a push member, a hooking member, an elastic member, a plurality of sleeves, a plurality of rotating discs, and a push disc;

the rod having a line of teeth axially spaced on an outer circumferential surface thereof, and being movably connected at one of two ends to the supporting plate and fixedly connected at the other end to an end of the push member;

the push member being provided at another end opposite to the rod with an engaging portion, and a slit disposed on each side of the engaging portion to receive the hooking member;

the hooking member being movably connected to the push member by engaging with the engaging portion; the hooking member having a first end in the form of a cross plate confined in the enclosure, and an opposite second end in the form of two hooking arms detachably extended into the holes on the insertion section;

the elastic member being located between the push member and the fixing seat;

the sleeves being mounted on and around the rod between the supporting plate and the push member, and each being provided with an axially extended slot corresponding to the teeth, two diametrically opposite and externally projected wing portions located at two sides of the slot, and an annular groove formed in and around an end of each sleeve to communicate with the axial slot;

the rotating discs being fitted on and around the sleeves, and each being provided along an outer circumferential surface with a plurality of sequentially arranged numeral areas, such that the numeral areas on the same one rotating disc can be selectively exposed from one of the windows on the enclosure corresponding to that rotating disc by turning the rotating disc; and the rotating discs each being provided on an inner circumferential surface with a toothed portion for detachably engaging with the wing portions on a corresponding sleeve; and the push disc being mounted on the rod at the end connected to the supporting plate; and at least two push buttons each being movably arranged at one of two lateral sides of the enclosure to interfere with the push member, wherein an inclined shoulder portion outwardly extended toward the engaging portion is formed on each side of the push member, with which the push buttons interfere.

2. The locking device with changeable combination of numerals for locking a connecting port on a computer as claimed in claim 1, wherein the enclosure is composed of an upper cover and a lower cover.

3. The locking device with changeable combination of numerals for locking a connecting port on a computer as claimed in claim 1, wherein the insertion section is configured as a USB plug.

4. The locking device with changeable combination of numerals for locking a connecting port on a computer as claimed in claim 1, wherein each of the push buttons has a push section outward protruded from the enclosure, and a driving head opposite to the push section for interfering with the push member.

* * * * *